US008567063B2

(12) United States Patent
Higuma et al.

(10) Patent No.: US 8,567,063 B2
(45) Date of Patent: Oct. 29, 2013

(54) METHOD OF MACHINING ORIFICE AND PRESS-WORKING METHOD

(75) Inventors: Masato Higuma, Hitachinaka (JP); Kenichi Gunji, Mito (JP); Atsushi Sekine, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 530 days.

(21) Appl. No.: 12/918,220

(22) PCT Filed: Jun. 26, 2009

(86) PCT No.: PCT/JP2009/062168
§ 371 (c)(1),
(2), (4) Date: Aug. 18, 2010

(87) PCT Pub. No.: WO2010/026828
PCT Pub. Date: Mar. 11, 2010

(65) Prior Publication Data

US 2011/0005077 A1 Jan. 13, 2011

(30) Foreign Application Priority Data

Sep. 5, 2008 (JP) ..... 2008-227719

(51) Int. Cl.
*B21D 51/16* (2006.01)

(52) U.S. Cl.
USPC ..... 29/890.142; 239/533.3

(58) Field of Classification Search
USPC ..... 29/890.142–890.143; 239/533.3–533.12
See application file for complete search history.

(56) References Cited

U.S. PATENT DOCUMENTS 4,801,095 A * 1/1989 Banzhaf et al. ..... 239/533.3
5,163,621 A * 11/1992 Kato et al. ..... 239/533.12

(Continued)

FOREIGN PATENT DOCUMENTS

EP 1 557 228 A1 7/2005
JP 2005-180375 A 7/2005
JP 2005180375 A * 7/2005
JP 2007-77843 A 3/2007

(Continued)

OTHER PUBLICATIONS

International Search Report dated Oct. 13, 2009 with English translation (four (4) pages).

(Continued)

*Primary Examiner* — David Bryant
*Assistant Examiner* — Jacob Cigna
(74) *Attorney, Agent, or Firm* — Crowell & Moring LLP

(57) ABSTRACT

It is an object of the present invention to enhance the orifice design freedom and easy machine ability in a fuel injection valve in which orifices are formed by press-working.

In a machining method for forming an orifice in a fuel injection valve by operating a punch 43 in an axial direction inclined relative to a normal direction perpendicular to a tangent plane of a curved surface portion 30 or relative to a perpendicular direction perpendicular to a slant surface of a slant surface portion, the machining method comprises a first step of operating the punch 43 along an axis 57*j* pre-shifted in parallel from an orifice axis 57*i* and pressing an orifice plate 15' to form a recess 577*a*, a second step, after the first step, of shifting an axis of the punch 43 to the position of the orifice axis 57*i* and forming a recess in a bottom 577*as* of the recess 577*a* formed in the first step, the recess formed in the second step being deeper than the recess 577, and a third step of forming an orifice in a bottom of the orifice formed in the second step.

10 Claims, 6 Drawing Sheets

(56) References Cited

U.S. PATENT DOCUMENTS

| | | | | |
|---|---|---|---|---|
| 5,934,571 | A * | 8/1999 | Schmidt et al. | 239/533.9 |
| 6,273,349 | B1 * | 8/2001 | Fischbach et al. | 239/585.1 |
| 6,624,382 | B2 * | 9/2003 | Kling | 219/121.67 |
| 7,082,921 | B2 * | 8/2006 | Shimizu et al. | 123/305 |
| 7,219,983 | B2 | 5/2007 | Akahane et al. | |
| 7,575,305 | B2 | 8/2009 | Akahane et al. | |
| 2005/0188736 | A1 | 9/2005 | Akahane et al. | |
| 2007/0057093 | A1 * | 3/2007 | Gunji et al. | 239/533.12 |
| 2007/0216736 | A1 | 9/2007 | Akahane et al. | |
| 2008/0029069 | A1 * | 2/2008 | Joseph | 123/456 |
| 2008/0296414 | A1 * | 12/2008 | Kubota et al. | 239/533.11 |

FOREIGN PATENT DOCUMENTS

| | | | | |
|---|---|---|---|---|
| JP | 2008-101499 | A | | 5/2008 |
| JP | 2008101499 | A | * | 5/2008 |
| WO | WO 2004/004943 | A1 | | 1/2004 |

OTHER PUBLICATIONS

Japanese Office Action including English language translation dated Mar. 6, 2012 (Nine (9) pages).

Partial mechanical English translation of reference B2 (JP 2005-180375) previously filed on Aug. 18, 2010 (One (1) page).

* cited by examiner

METHOD OF MACHINING ORIFICE AND PRESS-WORKING METHOD

TECHNICAL FIELD

The present invention relates to a press-working method suitable for a machining method for an orifice in a fuel injection valve used in an internal combustion engine of an automobile to inject fuel.

BACKGROUND ART

Heretofore there has been known a fuel injection valve in which a convex curved surface portion is formed on an orifice plate provided with orifices, plural recesses are formed in the convex curved surface portion, and outlets of the orifices are opened to the bottoms of the recesses respectively (see, for example, Patent Document 1). In this conventional fuel injection valve, the bottoms of the recesses are formed perpendicularly to the axes of the orifices respectively, and consideration is given so that fuel is injected at the same timing at the outlets of the orifices and in the circumferential direction thereof. Consideration is also given lest a bending stress should be imposed on a machining punch for orifice. The orifice length is adjusted by changing the recess depth. There also is known a fuel injection valve in which recesses are each formed in two steps (see, for example, Patent Document 2).

PRIOR ART DOCUMENTS

Patent Documents

Patent Document 1: Japanese Patent Laid-Open No. 2007-77843

Patent Document 2: Japanese Patent Laid-Open No. 2008-101499

SUMMARY OF THE INVENTION

Problems to be Solved by the Invention

In the fuel injection valve described in Patent Document 1, the recesses are endowed with a function of diminishing a bending stress imposed on the machining punch for orifice and an orifice length adjusting function. However, since the recesses are each formed by a single press-working, there occur restrictions on the press-working for orifices and recesses. For example, the angle between the punch and a recess machining surface (in the case of a spherical surface a tangent plane thereof) cannot be largely deviated from 90°, but if a large deviation is to be made, it is necessary to use a thick punch. If a deep recess is formed using a thick punch, there may result weakening of the orifice-forming member.

If the strength of the orifice-forming member becomes low in the course of machining for plural orifices or recesses, there sometimes is a case where it becomes difficult to carry out press-working for the next orifice or recess after press-working for a certain orifice or recess. The larger the number of orifices, the more difficult it becomes to carry out press-working, which may result in that the orifice design freedom (e.g., the number of holes, inclination angle, spacing) is restricted.

In case of forming many orifices, if an attempt is made to form a deep recess of a large diameter, there is a fear that adjacent orifices or adjacent recesses and orifices may interfere with each other. Particularly, if an angle of inclination of each orifice relative to the axis of the fuel injection valve is made different orifice by orifice to let the orifices face in a desired directions, the specific orifices or the specific recesses and orifices are apt to interfere with each other. Even if such interference does not occur, the distance from adjacent recesses becomes shorter and the recesses become easier to deform due to plastic flow in press-working. Upon deformation of the recesses, there is the possibility that a spray injecting direction will be deviated from an intended direction.

For such a reason, it is presumed that the orifice design freedom is limited.

Besides, since a bending stress is imposed on the punch during machining the recesses, it is difficult to straighten a recess with an aspect ratio of 1 or more. Moreover, when the angle of the punch axis is deviated largely from 90° relative to a recess machining surface (in the case of a spherical surface a tangent plane thereof), there no longer is obtained coaxiality between the recess and orifice. In view of this point, in the fuel injection valve described in Patent Document 2, the bending stress diminishing function for the recess machining punch and the orifice length adjusting function are separated from each other. In the fuel injection valve in question, each recess is constructed to have two steps composed of a recess B to which an orifice outlet is open and a recess A positioned on a downstream side of the recess B. The recess B has an orifice length adjusting function and the recess A has a bending stress diminishing function for a recess B machining punch. In this case, the recess A is larger in diameter than the recess B. In the fuel injection valve in question, because of the presence of the large-diameter recesses A, recesses A, or recesses A and orifices, become easier to interfere with each other between adjacent orifices. Particularly, if an attempt is made to make the angle of inclination, θ, relative to a nozzle axis 15*b* different orifice by orifice and let each orifice face in a desired direction, specific orifices or the specific recesses A and the orifices become easier to interfere with each other. Particularly, this tendency becomes marked in case of increasing the number of holes to six or more.

It is an object of the present invention to enhance the design freedom and easy machinability of holes in case of forming the holes by press-working, particularly the design freedom and easy machinability of orifices in a fuel injection valve in which the orifices are formed by press-working.

Means for Solving the Problems

According to the present invention, for achieving the above-mentioned object, there is provided a press-working method for forming a hole in an axial direction in a curved surface portion or a slant surface portion by operating a punch in the axial direction, the axial direction being inclined relative to a normal direction perpendicular to a tangent plane of the curved surface portion or relative to a normal direction perpendicular to a slant surface of the slant surface portion, which method comprises a first step of operating the punch along an axis pre-shifted in parallel from an axis of the hole to urge the curved surface portion or the slant surface portion, thereby forming a recess, and a second step, after the first step, of shifting the axis of the punch used in the first step to the position of the hole axis and operating the punch at the position of the orifice axis to form a hole in a bottom of the recess formed in the first step.

According to the present invention there also is provided a machining method for forming an orifice in a curved surface portion or a slant surface portion in a fuel injection valve by operating the punch in an axial direction inclined relative to a normal direction perpendicular to a tangent plane of the curved surface portion or relative to a normal direction perpendicular to a slant surface of the slant surface portion, which method comprises a first step of operating the punch along an axis pre-shifted in parallel from an axis of the orifice, pressing an orifice plate for forming the orifice to form a recess therein, a second step, after the first step, of shifting the axis of the punch used in the first step to the position of the orifice axis and operating the punch at the postion of the orifice axis and forming in a bottom of the recess formed in the first step a recess deeper than the recess formed in the first step, and a third step of forming an orifice in a bottom of the recess formed in the second step.

Advantages of the Invention

According to the present invention, in a method for forming holes by operating a punch in an axial direction inclined relative to a normal direction perpendicular to a tangent plane of the curved surface portion or relative to a normal direction perpendicular to the slant surface of the slant surface portion by press working, the method comprising a first step of operating the punch along an axis pre-shifted in parallel in advance from an orifice axis and pressing an orifice plate to form a recess therein, and a second step, after the first step, of shifting the axis of the punch used in the first step to the position of the orifice axis and operating the punch at the position of the orifice axis to form a recess in a bottom of the recess formed in the first step, the recess formed in the second step being deeper than the recess formed in the first step, by press-working, it is possible to reduce the bending stress acting on the punch and enhance the design freedom and easy machinability of the hole bending stress. Moreover, it is possible to enhance the design freedom and easy machinability of the orifices for forming orifices as forming holes.

MODE FOR CARRYING OUT THE INVENTION

Figure 1:
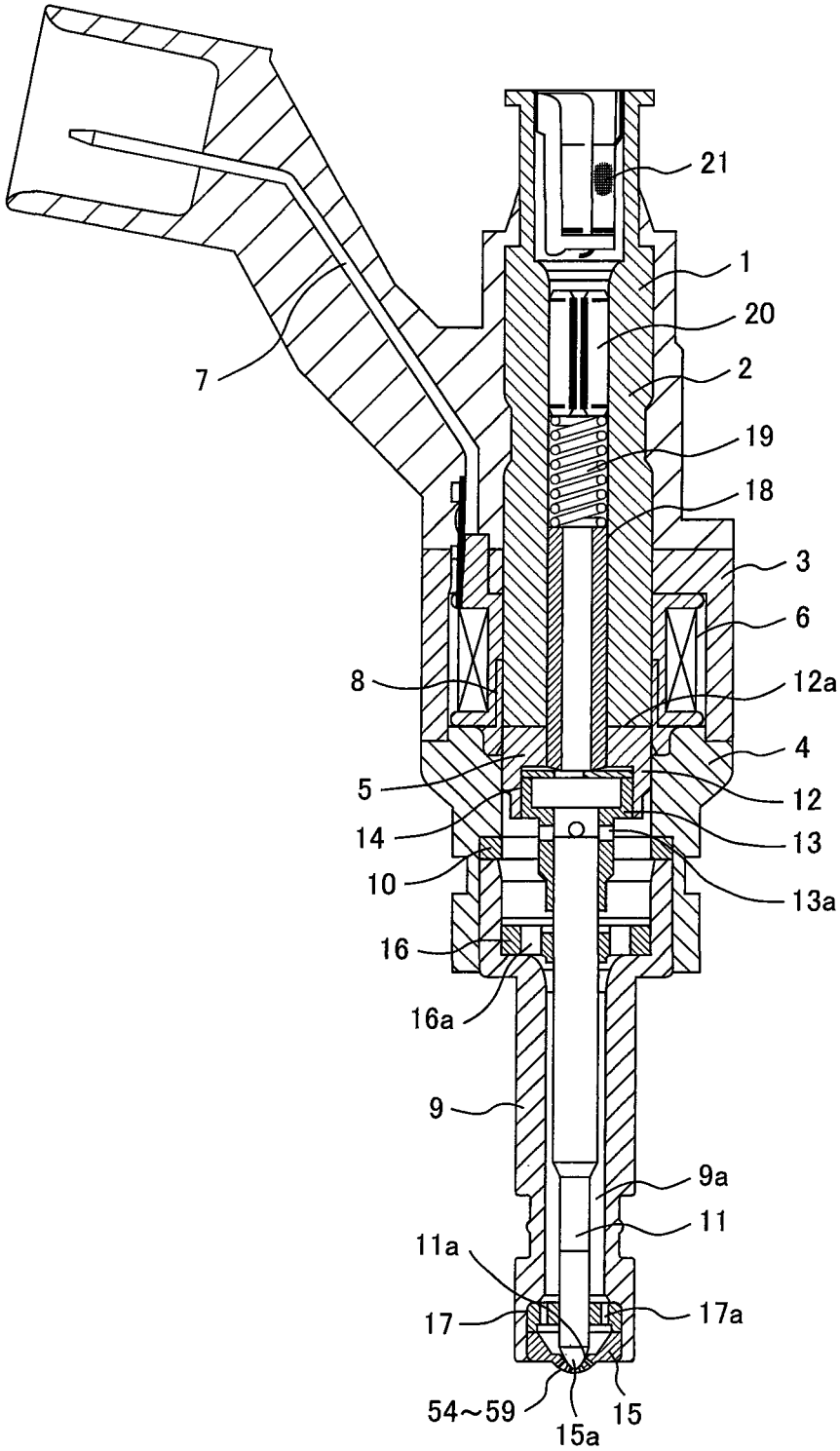
FIG. 1 is a vertical sectional view showing an entire configuration of an injection valve.

An embodiment of the present invention will be described below in detail with reference to the drawings. FIG. 1 is a vertical sectional view showing an entire configuration of an injection valve according to an embodiment of the present invention. The injection valve of this embodiment is a fuel injection valve for injecting fuel such as, for example, gasoline and is used for injecting fuel to an automobile engine.

An injection valve body 1 includes a magnetic circuit, the magnetic circuit comprising a core 2, a yoke 3, a housing 4 and a movable member 5, a coil 6 for energizing the magnetic circuit, and a terminal portion 7 for energizing the coil 6. A seal ring 8 is coupled between the core 2 and the housing 4 to prevent fluid such as fuel or the like from flowing into the coil 6.

Valve parts, including the movable member 5, a nozzle 9 and a ring 10 adjusting the stroke quantity of the movable member 5, are housed in the interior of the housing 4. The movable member 5 comprises a valve element 11 and a movable core 12 coupled together using a joint 13. Between the movable member 12 and the joint 13 is disposed a plate 14 which conjointly with a pipe 18 suppresses bounding when the movable member 5 moves to close the valve.

The housing 4 and the nozzle 9, which constitute a shell member, cover the circumference of the movable member 5. In the nozzle 9 are provided an orifice plate 15, the orifice plate 15 having at the tip thereof a seat surface 15*a* (valve seat) as a conical surface and orifices 54 to 59, and a guide plate 17 which together with a guide plate 16 guides the movable member 5 slidably. The orifice plate 15 and the guide plate 17 may be constructed separately or integrally with respect to the nozzle 9.

In the interior of the core 2 are disposed a spring 19 for urging the valve element 11 to the seat surface 15*a* via the pipe 18 and the plate 14, an adjuster 20 for adjusting an urging load on the spring 19, and a filter 21 for preventing the entry of contamination from the exterior.

Now, a detailed description about the operation of the fuel injection body 1 will be given below.

When the coil 6 is energized, the movable member 5 is attracted toward the core 2 against the urging force of the spring 19 and a gap is formed (valve open condition) between a valve seat portion 11*a* and the seat surface 15*a* which are located at the tip of the movable member 5. Pressurized fuel first flows from the core 2, adjuster 20 and pipe 18 into the nozzle 9 through a fuel passage 13*a* formed within the movable member 5. Next, the fuel flows from a fuel passage 16*a* formed in the guide plate 16 and a passage 9*a* formed in the nozzle into a passage 17*a* formed in the guide plate B, then flows through the gap between the valve seat portion 11*a* and the seat surface 15*a*, further through the orifices 54 to 59 and is injected. The orifices 54 to 59 are formed at different angles in deflected directions relative to a central axis (hereinafter referred to simply as the "axis") of the fuel injection valve.

On the other hand, upon de-energization of the coil 6, the valve seat portion 11*a* of the movable member 5 comes into abutment against the seat surface 15*a* by virtue of the spring 19 and the valve assumes a closed condition.

Next, a detailed description about the constructions of the orifice plate 15 and orifices 54 to 59 in the fuel injection valve body 1 will be given below.

Figure 2:
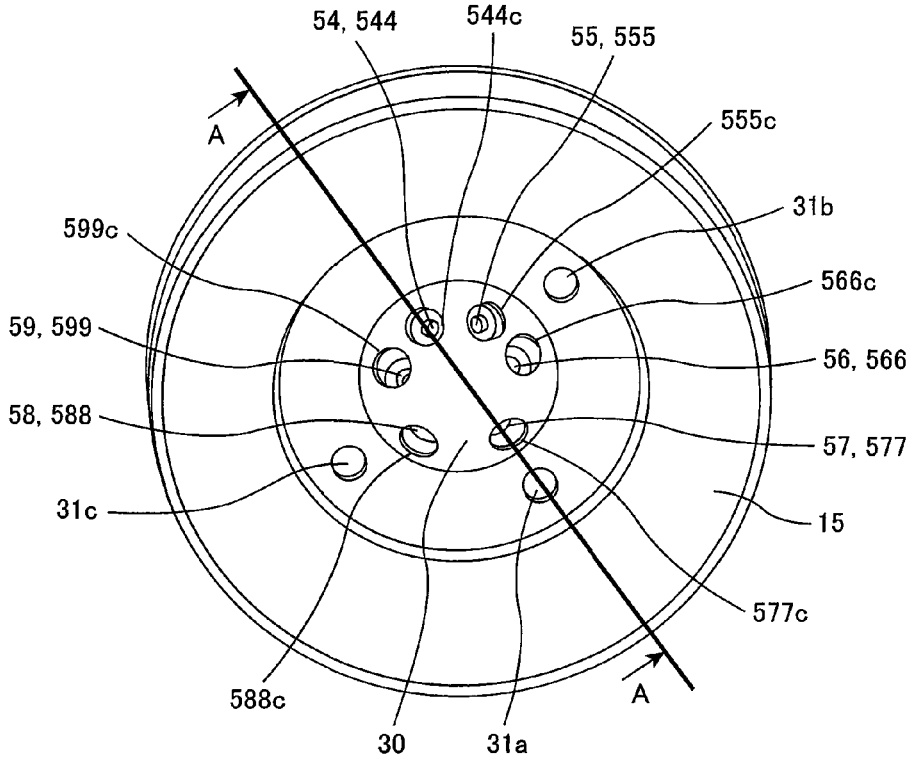
FIG. 2 is a perspective view of an orifice plate.
Figure 3:
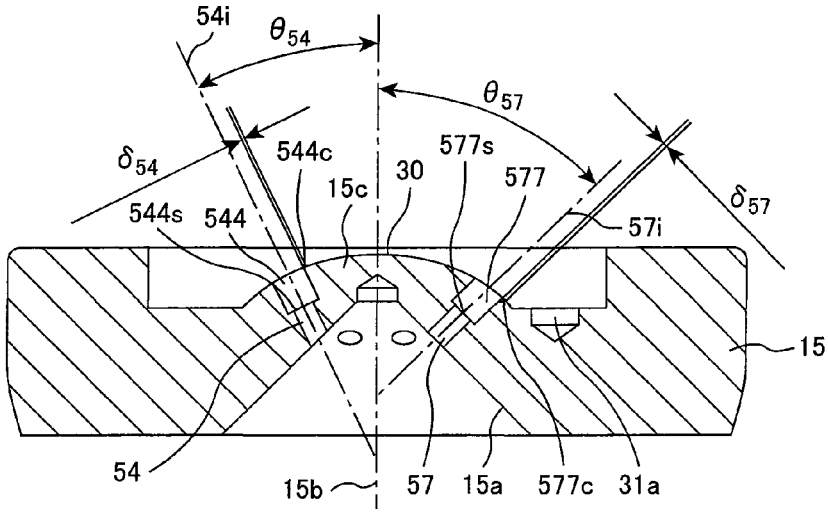
FIG. 3 is a vertical sectional view of the orifice plate.
Figure 4:
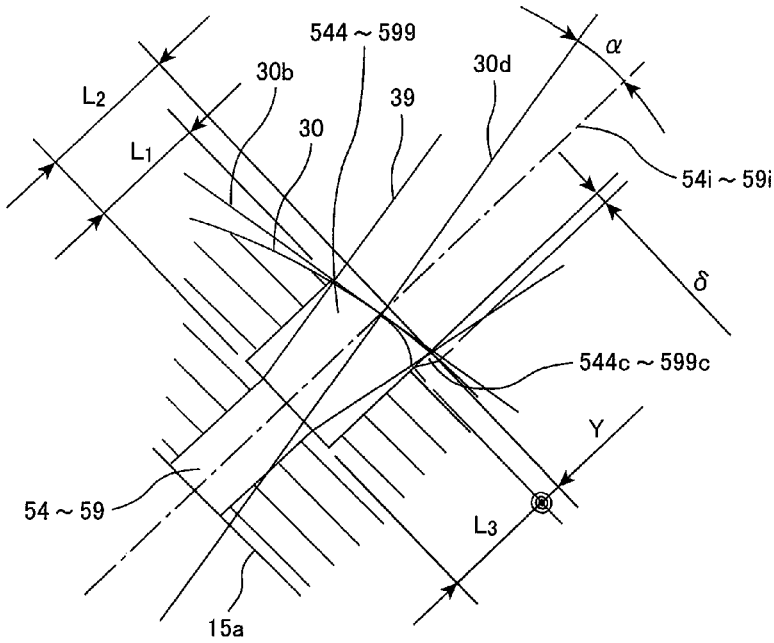
FIG. 4 is an enlarged sectional view of portions surrounding an orifice shown in FIG. 3.

FIGS. 2, 3 and 4 illustrate the embodiment of the invention, of which FIG. 2 is a perspective view of the orifice plate 15, FIG. 3 is a vertical sectional view thereof, and FIG. 4 is an enlarged sectional view of portions surrounding an orifice shown in FIG. 3.

The orifice plate 15 is a generally disc-like metallic plate. A spherical portion 30 as a curved convex portion is integrally formed at an approximately central part of one end face of the orifice plate 15 and a generally conical seat surface 15*a* which constitutes a valve seat is formed at an end face of the orifice plate 15 on the side opposite to the spherical portion 30.

In the spherical portion 30, orifices 54, 55, 56, 57, 58 and 59 for fuel injection are formed in directions having angles θ(see FIG. 3) relative to the axis of the fuel injection valve (coincident with a nozzle axis 15*b*), namely, in deflected directions. In this embodiment, the value of θ differs orifice by orifice and the orifices are formed so as to face in desired directions respectively. Of course, there may be orifices each with an equal angle of θ.

The valve element 11 is provided so as to be movable into contact with and away from the seat surface 15*a* which is located upstream of the orifices.

The fuel injection valve body 1 is mounted to an automobile in a state in which its rotational direction is established by the terminal portion 7. Therefore, it is necessary for the orifice plate 15 to be installed in the fuel injection valve body 1 in a state in which its rotational direction is established relative to the terminal portion 7. However, since the orifices 54, 55, 56, 57, 58 and 59 are formed at different angles in deflected directions relative to the nozzle axis 15*b*, they cannot be used for establishing the rotational direction of the orifice plate 15.

In view of this point, bottomed recesses 31*b* and 31*c* are formed at opposed positions spaced 180° away from each other in the circumferential direction of the outer periphery of the spherical portion of the orifice plate 15. As a result, it is possible to form an axis joining the recesses 31*b* and 31*c*, so that the orifice plate 15 can be installed in the injection valve body 1 in a state in which its rotational direction is established relative to the terminal portion 7. Moreover, a type determining hole 31*a* is formed between the recesses 31*b* and 31*c* in the circumferential direction of the outer periphery of the spherical portion. Even if the deflection angle is changed slightly, a visual determination of the type is difficult, so the position, diameter, or shape, of the type determining hole 31*a* is changed (for example, the shape thereof is changed into a conical shape), thereby permitting easy determination of the type.

Thus, by forming the orifices 54, 55, 56, 57, 58 and 59 at different angles in directions deflected relative to the nozzle axis 15*b*, fuel can be injected in a desired direction. Therefore, by changing the direction of fuel injection, it is possible to form various spray patterns corresponding to combustion concepts which conform to various manufacturers' engine specifications. By injecting fuel while sidestepping an intake valve and by gathering the fuel around a sparking plug, the fuel can be injected uniformly into a combustion chamber and it is possible to form a mixture with air extremely ideally without impairing atomization.

As shown in FIG. 3, downstream of the orifices 54, 55, 56, 57, 58, and 59, there are respectively provided recesses 544, 555, 566, 577, 588, 599, and tapered portions 544*c*, 555*c*, 566*c*, 577*c*, 588*c*, and 599*c*, of the recesses.

As shown in FIG. 4, it is assumed that the width and depth of each tapered portion are δ and Y, respectively, and an angle difference between a normal 30*d* of the spherical portion 30, the normal 30*d* passing through a point of intersection between each of orifice axes 54*i* to 59*i* and the spherical portion 30, and each of the orifice axes 54*i* to 59*i* is α. The angle difference a depends on the value of the deflection angle θ. Bottoms 544*s* to 599*s* of the recesses are formed so as to have surfaces intersecting the orifice axes 54*i* to 59*i* respectively at approximately right angles. These recess axes and orifice axes are aligned substantially in a straight line. The depths of the recesses vary in the circumferential direction and the depth Y is a half or less of the diameter of each recess. The tapered portions 544*c* to 599*c*, which are spread toward the downstream side, are each formed in part of a downstream side of the deepest portion of the associated recess.

With respect to the orifices 54 and 57, as shown in FIG. 3, an angle θ54 between an axis 54*d* and the nozzle axis (coincident with the valve axis in this embodiment) 15*b* and an angle θ57 between an axis 57*d* and the nozzle axis 15*b* are different from each other. The angle θ may be made different with respect to all the orifices 54, 55, 56, 57, 58 and 59, or the orifices may be divided into plural groups and the angle θ may be made different group by group. The angle θ may be made the same with respect to all the orifices, but this embodiment is effective particularly in the case where orifices different in angle θ are present as will be described later.

As to the orifices 54 and 57, the widths δ54 and δ57 of the respective tapered portions are different from each other. The larger the angle difference α, the larger the tapered portion concerned.

The orifices 54 to 59 have respective outlet-side apertures in the bottoms 544*s* to 599*s* of the recesses formed on the spherical surface of the convex spherical portion 30 and have respective inlet-side apertures in the generally conical surface which constitutes the seat surface 15*a*.

The orifice length is highly sensitive to the length of penetration. By changing the depth (difference in height) of each recess it is possible to optimize the orifice length and hence possible to optimize the spray shape and facilitate machinability. Therefore, at least two of the recesses are different in depth from each other orifice by orifice. In this case, the rigidity of the orifice plate 15 is not deteriorated because it is not necessary to change the thickness of a tip portion 15*c* of the orifice plate. Thus, this embodiment is suitable for a high fuel pressure type injection valve with a pressure as high as 10 MPa imposed on the tip portion 15*c* of the orifice plate.

In such a mode as this embodiment in which an orifice inlet is opened to the valve seat surface, the orifice machining member is thicker than in case of forming an orifice in a thin and uniform plate member. Particularly, in the case where orifice inlet apertures are arranged on a circumference centered on the nozzle axis 15*b* (coincident with the axis of the fuel injection valve) and the inclination angle θ of the orifice relative to the nozzle axis 15*b* is made different between orifices, the outlet apertures of orifices are no longer arranged on the circumference centered on the nozzle axis 15*b*. In this case, the orifice penetrating distance differs orifice by orifice, with the result that the orifices become different in length. In such a mode, therefore, it becomes important that the length of each orifice be adjusted by the associated recess.

However, if an attempt is made to form each recess by a single machining, it becomes difficult to freely change the diameter and depth of the recess and the inclination angle A of the recess. This is for the following reasons.

(1) The larger the deviation of the angle between a punch and the machining surface from 90° (the larger the angle difference α), the larger the bending stress acting on the punch. In this case, if a thick punch is used taking the bending stress acting on the punch into account, the strength of the orifice machining member becomes low. Besides, even if a thick punch is used, it is impossible to make the bending stress nil and hence a hole is formed in a bent state. Moreover, even if a thick punch is used, a hole with an aspect ratio of 1 or more cannot be formed because of shortening of the punch life.

(2) In case of forming many orifices, if recesses large in diameter are formed deep, recesses, or recesses and orifices, are apt to interfere with each other between adjacent orifices. Particularly, if the inclination angle θ relative to the nozzle axis 15*b* is made different orifice by orifice to let each orifice face in a desired direction, recesses, or recesses and orifices, are apt to interfere with each other between specific orifices.

If the bending stress reducing function for the recess forming punch and the orifice length adjusting function are separated and there is adopted a two-step configuration comprising orifice length adjusting recesses B positioned on the upstream side and bending stress reducing recesses A for a punch to form the recesses B, the recesses A being larger in diameter than the recesses B, the recesses A, or the recesses A and orifices, are apt to interfere with each other between adjacent orifices. Particularly, if the inclination angle θ relative to the nozzle axis 15*b* is made different orifice by orifice to let each orifice face in a desired direction, the recesses A, or the recesses A and orifices, become easier to interfere with each other between specific orifices. Particularly, this tendency is marked in case of increasing the number to holes to six or more.

This embodiment has solved the above-mentioned problems by machining each recess dividedly in two steps. More specifically, a tapered portion (recess A) of each recess is formed by first machining in which a bending stress is imposed on the punch, then in second machining, the punch axis is shifted in parallel and machining is carried out for a planar portion while sidestepping the tapered portion, thereby forming a recess while preventing a bending stress from being applied to the punch. In this way it is possible to form recesses and orifices high in both machining accuracy and design freedom and easy to machine. This embodiment is effective particularly when the number of holes is six or more.

Also in the case where the orifice plate is made thick to enhance the strength thereof, this embodiment is effective because a recess can be machined in an aspect ratio of 1 or more.

When fuel is injected from an orifice according to this embodiment, a sectional shape of its spray becomes a fan shape which is symmetric right and left. In this case, if there is no tapered portion at the outlet of each recess and the angle difference α is large, the difference between a maximum value L2 and a minimum value L1 of the recess depth becomes large, thus giving rise to the problem that the spray strikes against the L2 portion and does not become uniform.

On this regard, according to this embodiment there are formed tapered portions 544*c* to 599*c* to prevent the spray from striking against the L2 portion of a large recess depth, whereby it is possible to improve the uniformity of the spray.

The larger the angle difference α, the larger the difference between L1 and L2, but by forming the width δ in such a manner that the larger the angle difference α, the larger the width α, it is possible to prevent the spray from striking against the L2 portion of a large recess depth even if the difference between L1 and L2 becomes large. Consequently, the fluid injection timing becomes uniform throughout the whole circumference and the length of penetration can be made uniform even in the case of an orifice deflected relative to the nozzle axis 15*b*, thus making it possible to improve the uniformity of the spray.

Figure 5:
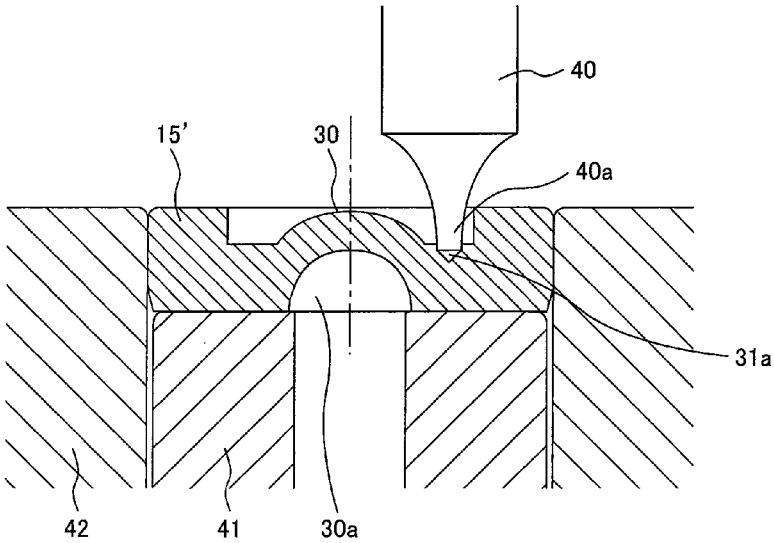
FIG. 5 is a diagram showing a state in which a positioning hole is being formed.
Figure 6:
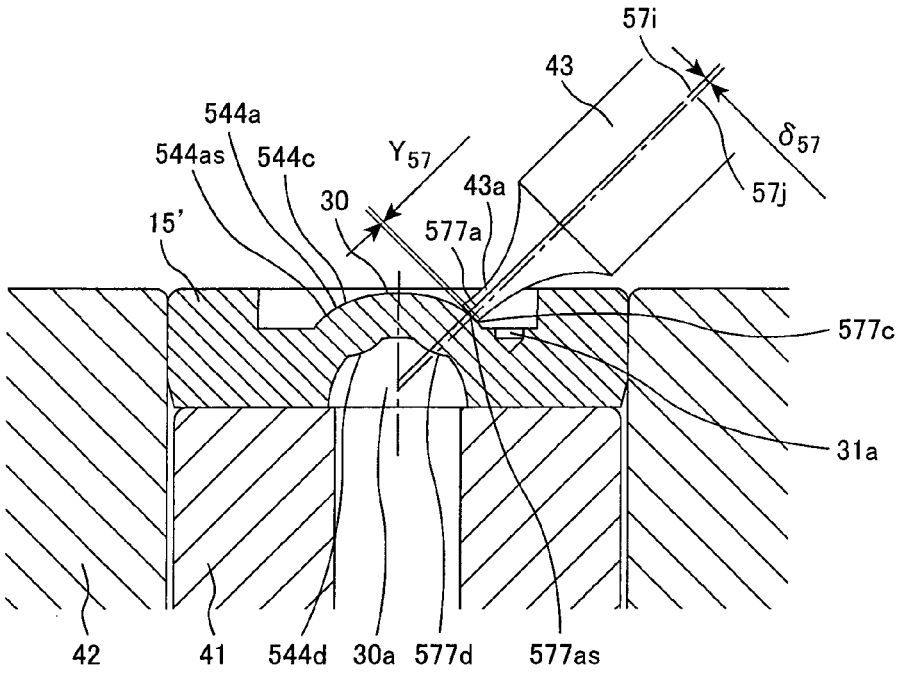
FIG. 6 is a diagram showing a state in which a recess A (a tapered portion of the recess) is being formed.
Figure 7:
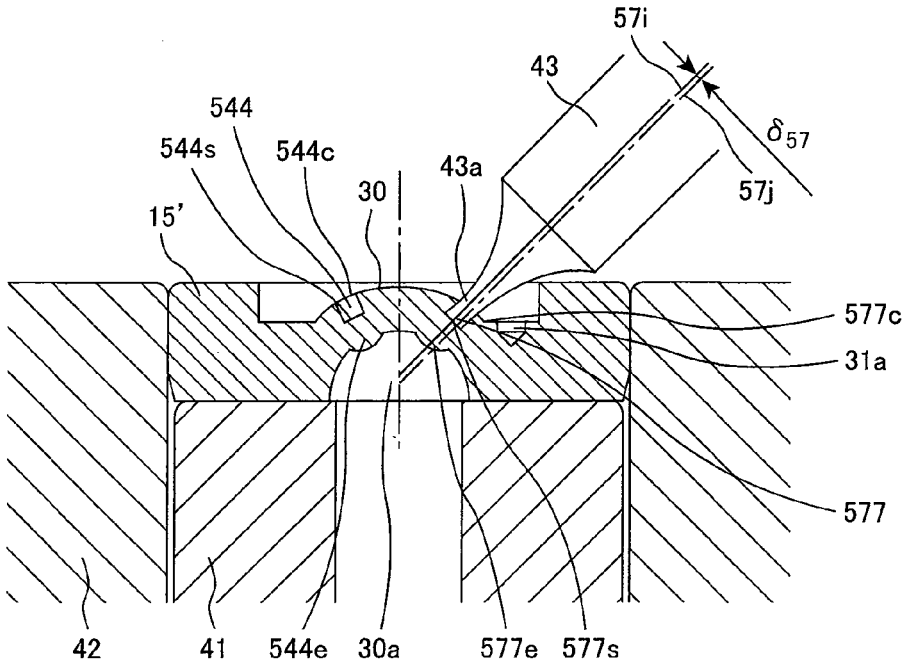
FIG. 7 is a diagram showing a state in which a recess is being formed.
Figure 8:
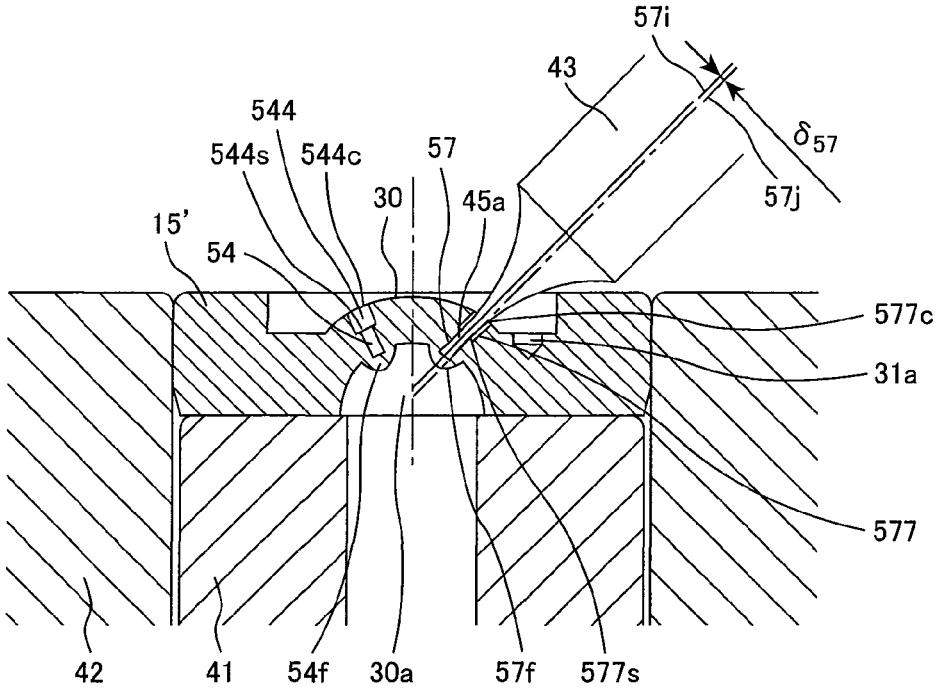
FIG. 8 is a diagram showing a state in which an orifice is being formed.
Figure 9:
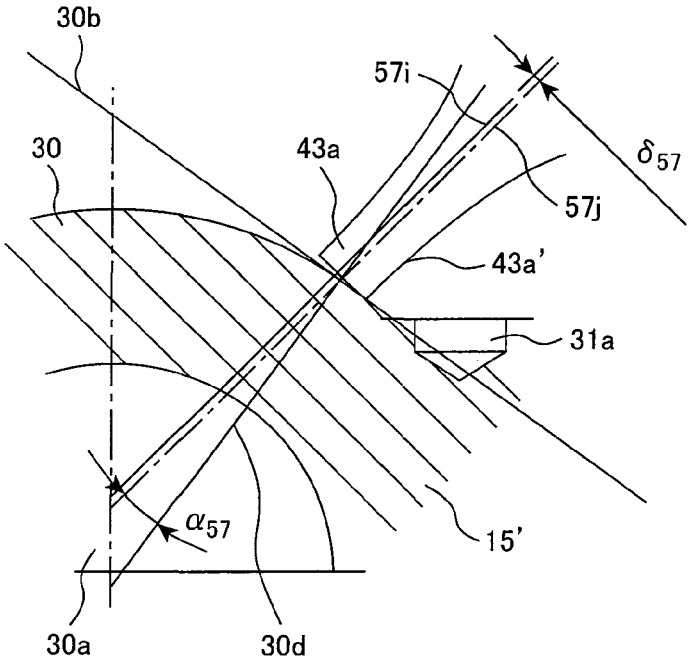
FIG. 9 is an enlarged diagram (showing a punch-contacted state) of FIG. 6.
Figure 10:
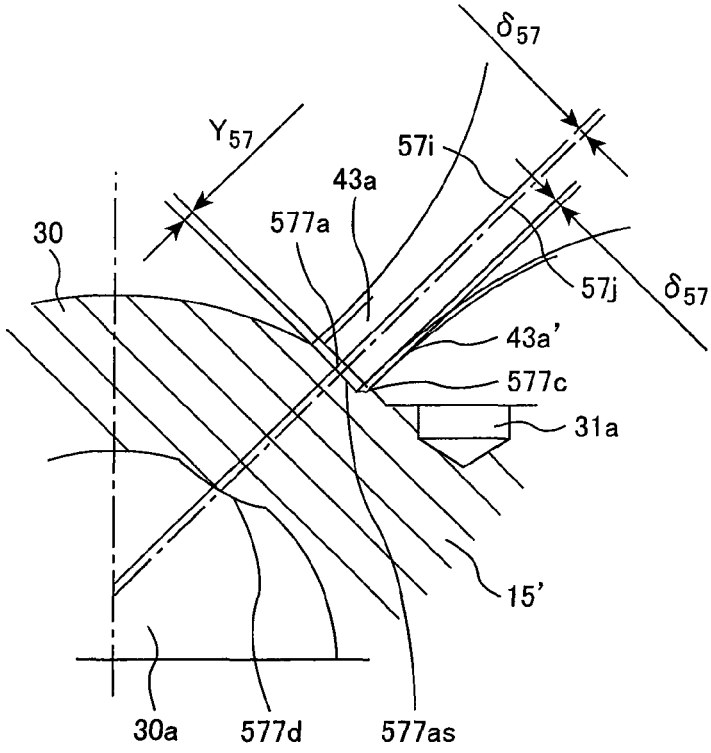
FIG. 10 is an enlarged diagram (showing a pushed-in state of the punch) of FIG. 6.
Figure 11:
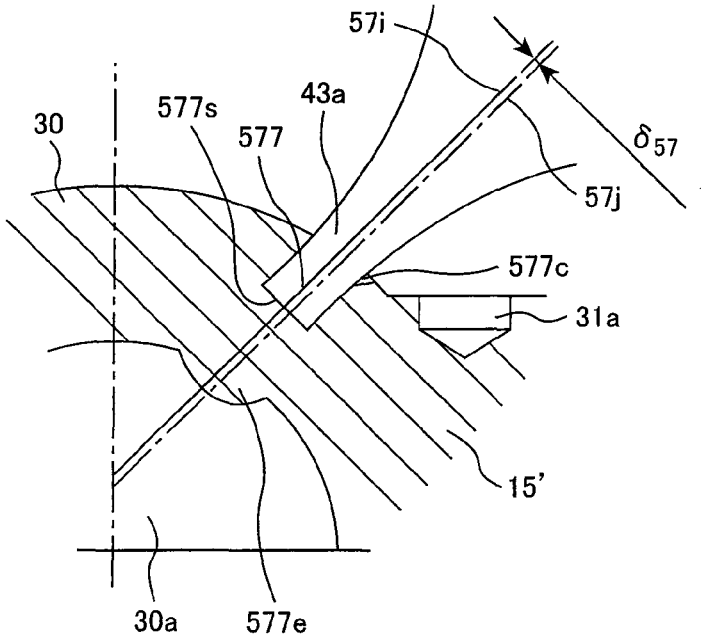
FIG. 11 is an enlarged diagram of FIG. 7.

Next, with reference to FIGS. 5 to 11, a description will be given about a method for machining the orifice plate 15. FIG. 5 is a diagram showing a state in which a type determining hole 31*a* is being formed. FIG. 6 is a diagram showing a state in which a recess A (a tapered portion of the recess) 577*a* is being formed. FIG. 7 is a diagram showing a state in which a recess 577 is being formed. FIG. 8 is a diagram showing a state in which an orifice 57 is being farmed. FIG. 9 is an enlarged diagram (showing a punch contacted state) of FIG. 6. FIG. 10 is an enlarged diagram (showing a pushed-in state of the punch) of FIG. 6. FIG. 11 is an enlarged diagram of FIG. 7.

As shown in FIGS. 5 to 11, a blank 15' of an orifice plate 15 has a spherical portion 30 at a nearly central part of an end face thereof, with a bowl-like recess 30*a* being formed in an end face of the side opposite to the spherical portion 30.

First, as shown in FIG. 5, the blank 15' formed with the spherical portion 30 is installed on an upper surface of a die 41 and an outer periphery thereof is held firmly by a collet chuck 42. Further, while holding the blank 15', an outer periphery of the spherical portion 30 is urged by a cutting blade 40*a* of a punch 40 to form a type determining hole 31*a*. Likewise, positioning holes 31*b* and 31*c* are formed. In this way there is obtained an orifice plate 15 having the positioning holes 31*b*, 31*c* and the type determining hole 31*a* in three positions of the outer periphery of the spherical portion 30.

Next, in the state in which the orifice plate 15 is held by the collet chuck 42, as shown in FIG. 6, a punch 43 is operated at a position 57*j* parallel-shifted by δ57 relative to an axis 57*i* of an orifice 57, allowing a cutting blade 43*a* of the punch 43 to urge the spherical portion 30 and allowing a recess A577*a* to be formed in a blind hole shape by extrusion. In the state of FIG. 9 the cutting blade 43*a* is in contact with the spherical portion 30, and the position which an outer periphery portion of the cutting blade 43*a* assumes at this time is indicated at 43*a'*. As the punch is pushed in from this state, as shown in FIG. 10, the cutting blade 43*a* comes into one-side contact with the spherical portion, which is bent in proportion to the depth, so that a tapered portion 577*c* is formed at the deepest portion of the recess A577*a*. Further, the center of a bottom 577*as* of the recess A577*a* becomes almost the same as the orifice axis 57*i*. At this time, the punch 43 is pushed in up to the position where the depth on the side opposite to the tapered portion 577*c* becomes almost zero. If the punch is pushed in too much, the punch becomes easier to break and thus the life thereof is shortened. A protuberant portion 577*d* is formed in the interior of the bowl-like recess 30*a*.

In this case, the parallel shift quantity (width of each tapered portion) δ is determined in advance in accordance with the following experimental equation:

$$\delta = K\alpha - 0.4 \times (0.1 - Y)$$

δ: parallel shift quantity (width of the tapered portion)

K: coefficient

α: angle difference from the machining surface

Y: punch push-in quantity (depth of the tapered portion)

According to an experiment conducted by the present inventor, the coefficient K was 0.002 at a punch tip diameter of 0.55. The value of α depends on the orifice deflection angle θ. If the punch push-in quantity is set too large, the punch life becomes shorter and therefore the value of Y is set to half or less of the recess diameter. As to the punch push-in quantity Y, it is desirable to set such a value as becomes zero at the shallowest position of each recess A.

The following description is now provided about in what procedure the parallel shift quantity and the parallel shift direction are determined, with reference to the recess A577*a* as an example.

First, a punch push-in quantity Y57 will be calculated in case of the shallowest position of the recess A577*a* becoming zero.

Then, a parallel shift quantity δ57 will be calculated in accordance with the foregoing experimental equation.

A position 57*j* occupied after a parallel axis shift from the axis 57*i* of the orifice 57 by a predetermined quantity δ57 with respect to the deepest direction of the recess A is an axial position of the machining punch 43 for the recess A577*a*.

In forming the recess A, the push-in depth Y is set to half or less of the punch diameter, so that the bending stress imposed on the punch is sufficiently small against the transverse rupture force of the punch. Therefore, as shown in FIG. 9, even if press-working is conducted against the spherical portion 30 in the presence of the angle difference δ, the cutting blade 43*a* of the punch 43 becomes difficult to break.

Recesses A544*a*, 555*a*, 566*a*, 588*a* and 599*a* are formed by machining in the same way as above. The order of machining is determined appropriately on the basis of orifice deflecting directions. At this time, in the interior of the bowl-like recess 30*a* there are formed protuberant portions A544*d*, 555*d*, 566*d*, 588*d* and 599*d*. As is apparent from the foregoing experimental equation, the larger the angle difference α from the machining surface, the larger the width δ of each tapered portion.

As to the machining for the recesses A, it is preferable that work hardening be made for the surface together with press-working. By thus forming the recesses A having tapered portions in the orifice plate 15 by press-working, there are formed recesses A having tapered portions in the spherical portion 30, the recesses A each having a surface approximately orthogonal to the orifice axis and having reduced surface roughness, as shown in FIG. 10.

Next, as shown in FIG. 7, while holding the orifice plate 15 by the collet chuck 42, and with the cutting blade 43*a* of the punch 43 which has formed the recesses A, the bottom of the recess A577*a* is urged to the position 57*i* concentric with the associated orifice in the same direction as the associated recess A to forma recess 577 in a blind hole shape by extrusion. At this time, a protuberant portion 577*e* larger than the protuberant portion 577*d* is formed in the interior of the bowl-like recess 30*a*. Likewise, recesses 544, 555, 566, 588 and 599 are formed. The order of machining is determined appropriately on the basis of the deflecting directions of the orifices. At this time, protuberances 544*e*, 555*e*, 566*e*, 588*e* and 599*e* are formed in the interior of the bowl-like recess 30*a*. In this case, it is preferable that the surfaces be subjected to work hardening together with press-working. By thus forming recesses in the orifice plate 15 by press-working there is obtained such an orifice plate 15 as shown in FIGS. 7 and 11 which has recesses with reduced surface roughness.

Since the surfaces are subjected to work hardening by press-working of the recesses A544*a*, 555*a*, 566*a*, 577*a*, 588*a*, 599*a* and the recesses 544, 555, 566, 577, 588, 599, edges of the recesses and orifices can be formed beautifully with high accuracy.

Besides, during machining for the recesses 544-599, the machining is conducted for the planar portions 544*as* to 599*as* while sidestepping the tapered portions 544*c* to 599*c* of the recesses A, so that the cutting blade 43*a* of the punch 43 does not undergo bending, and a hole having a depth larger than the punch diameter can be formed straight. Consequently, each recess can be formed at an aspect ratio of 1 or more.

Further, bottom surfaces 544*s* to 599*s* of the recesses 544-599 can be formed as right-angled surfaces free of displacement in comparison with bottom surfaces 544*as* to 599*as* of the recesses A.

Next, as shown in FIG. 8, while holding the orifice plate 15 by the collet chuck 42, a cutting blade 45*a* of a punch 45 is urged perpendicularly to the bottom surface 577*s* of the recess 577 and an orifice 57 is formed in a blind hole shape by extrusion. At this time, a protuberant portion 57*f* larger than the protuberant portion 577*e* is formed in the interior of the bowl-like recess 30*a*. Likewise, orifices 54, 55, 56, 58 and 59 are formed. The order of machining is determined appropriately on the basis of deflecting directions of the orifices. At this time, protuberant portions 54*f*, 55*f*, 56*f*, 58*f* and 59*f* are formed in the interior of the bowl-like recess 30*a*. By thus forming orifices in the orifice plate 15 by press-working there is obtained such an orifice plate 15 as shown in FIG. 8 which has orifices in the bottoms of the recesses. Since the orifice plate 15 is in such a state as is held by the collet chuck 42, the machining is carried out with high positional accuracy and high coaxiality in such a manner that the axes of the recesses and the axes of the orifices are aligned substantially in a straight line in relation to the positioning holes. By forming each orifice in a blind hole shape its inner surface can be machined to an entire shear plane and it is possible to reduce the surface roughness remarkably. In this case, by forming the protuberant portions 544*e* to 599*e* at the time of forming the recesses 544-599, a tensile force of material induced by the cutting blade 45*a* of the punch 45 can be made small even if the orifice machining punch is put into the interior of the bowl-like recess 30*a*. Consequently, rupture does not spread in the protuberant portions 544*e* to 599*e*, the orifices 54 to 59 can be formed at an entire shear plane, and it is possible to suppress variations in spray.

In the case where an orifice is deflected relative to the normal direction of the spherical portion 30, there occurs a one-side contact of the punch when forming each recess A, thus giving rise to the problem that a bending load is imposed on the cutting blade 43*a* of the punch 43, with consequent damage of the punch 43. According to this embodiment, however, since the bending load is sufficiently small in comparison with the transverse rupture force of the punch, the punch 43 is not damaged and there can be formed a planar portion approximately perpendicular to the orifice axis. Besides, in the subsequent machining step for the recess and also during machining for the associated orifice, a bending load is imposed on neither the cutting blade 43*a* of the punch 43 nor the cutting blade 45*a* of the punch 45, so that both recess and orifice can be formed with high coaxiality by press-working without damaging the punches 43 and 45. The bottom of each recess A and that of each recess formed subsequent to the recess A each intersect the axis of the associated orifice at approximately right angles, but it is possible to make the bottom of the latter recess intersect the orifice axis more perpendicularly.

Lastly, the protuberant portions 54*f* to 59*f* which have been formed in the end-face recess on the side opposite to the spherical portion 30 by forming orifices each in a blind hole shape are removed by forming a generally conical seat surface 15*a* (valve seat) as shown in FIG. 3 and the orifices penetrate to the seat surface 15*a* side. This machining is carried out by cutting or electric discharge machining. As a result, the orifices can be formed at an entire shear plane. The flow rate of fuel at a constant fuel pressure is highly sensitive to the orifice diameter, so for the control of flow rate it is necessary to control the orifice diameter accurately. According to this embodiment, the control of only the punch diameter suffices for the control of hole diameter and thus the control is easy. In contrast therewith, an orifice formed by punching is large in the hole diameter of a fracture surface and the length of the fracture surface varies, thus the control of hole diameter is difficult in comparison with the orifice formed according to this embodiment. As to an orifice formed by electric discharge machining, it is necessary to control machining conditions such as machining speed and voltage in addition to control of the electrode diameter and thus the control of hole diameter is difficult in comparison with the orifice formed according to this embodiment.

Thus, by forming recesses in the spherical portion located on the downstream side of orifices, the recesses being concentric with the axes of the orifices respectively and each having a approximately perpendicular surface and having a tapered portion at a deepest position of a stepped portion, orifices different in the direction of fuel injection can be formed easily with high accuracy by press-working. Therefore, even martensitic stainless steel with a carbon content of 0.25% or more, (e.g., SUS420J2), can be easily subjected to press-working to form orifices of 1.5 or more in aspect ratio. In case of using martensitic stainless steel with a carbon content of 0.25% or more, it is more preferable that the hardness after quenching be HRC 52 or more.

Besides, since spray does not come into contact with each recess under the action of the associated tapered portion, the spray can be prevented from being streaked, and fuel which has come into contact with a recess can be prevented from dropping into an engine cylinder with consequent development of a foreign matter such as carbon.

Moreover, since the outlet of each orifice provides a plane orthogonal to the orifice axis, the fluid injection timing becomes equal throughout the whole circumference, and even in an orifice deflected relative to the axis of the injection valve it is possible to make the length of penetration uniform and hence possible to improve the uniformity of spray.

Further, by changing the recess depth it is possible to change the orifice length and thereby possible to optimize the spray shape. In this case, the rigidity of the orifice plate is not deteriorated because it is not necessary to change the thickness of the orifice plate tip 15*c*. Therefore, this embodiment is suitable for a high fuel pressure type injection valve in which the pressure imposed on the orifice plate tip 15*c* is as high as 10 MPa or more.

Moreover, by forming each recess A at a parallel-shifted position relative to the orifice axis, a bending load is no longer imposed on the punch during machining for a recess or orifice and press-working can be carried out in high coaxiality for the recess and orifice. Consequently, machining can be done with reduced surface roughness as compared with, for example, an orifice formed by electric discharge machining or cutting. As a result, it is possible to diminish the deposition of combustion cinders such as carbon on the recesses and orifices which cinders result from combustion of fuel in direct injection, thus making it possible to effect atomization of spray and improvement of its shape and positional accuracy. According to a running test with an actual gasoline-fueled vehicle, in a fuel injection valve using an orifice plate having orifices formed by electric discharge machining and having one step of recesses, combustion cinders were deposited on both recesses and orifices, with a consequent 15% lowering of flow rate. This was made clear experimentally by the above test. In comparison with the orifice plate having gone through electric discharge machining, the orifice plate obtained according to this embodiment is superior in coaxiality and surface roughness of recesses and orifices, so that the deposition of combustion ciders on the recesses and orifices could be diminished and it was possible to suppress a change in flow rate to 1.7% or less.

Further, by forming positioning holes, recesses and orifices while chucking a blank, a plurality of orifices deflected relative to the injection valve axis can be established their positions and subjected to machining with high accuracy in each step without the need of alignment.

Moreover, in the machining method according to this embodiment in which orifices are formed by press-working, in comparison with the method in which orifices are formed by electric discharge machining, the machining time per hole can be shortened to about one thirtieth, so that it is possible to suppress equipment investment and hence possible to provide an orifice plate less expensive than the orifice plate obtained by electric discharge machining.

Although an embodiment of the present invention has been described above concretely, the present invention is not limited to the above embodiment, but various changes may be made within the scope of its inventive idea.

For example, in the case where there is a margin of spacing between adjacent holes, by making the tip diameter of the machining punch for the recesses A larger than that of the machining punch for the recesses to be formed subsequent to the recesses A, for the purpose of enhancing the resistance to breakage of the machining punch for the recesses A, it is possible to form recesses in a two-step shape. At this time, since the recesses A and the recesses to be formed next can be formed in high coaxiality, the diameter of each recess A can be made smaller than in the machining method not involving axis displacement. Besides, since the larger the angle difference $\alpha$, the larger the tapered portion formed, the recesses A are difficult to contact the spray and the spray can be made uniform.

Although in the above embodiment a description was given on the assumption that the area where the recesses are formed correspond to the spherical portion 30, the area in question may be any other curved surface area (curved surface portion) or slant surface portion than the spherical surface.

Although in the above embodiment the orifices were formed by extrusion, there may be adopted a method in which at the time of forming orifices by punching and subsequently cutting the seat surface from the upstream side or by electric discharge machining, fracture surfaces of the orifices may be removed and the orifices may be formed at an entire shear plane.

In the above embodiment, the rigidity (strength) of the nozzle plate 15 is not deteriorated over the period from during press-working of orifices and recesses until after the machining, so it is possible to facilitate press-working and hence possible to attain a machining method of high productivity for fuel injection valves and orifices.

Further, it is possible to prevent mutual interference of orifices and recesses between adjacent orifices and enhance the orifice design freedom (e.g., the number of holes, inclination angle, spacing).

EXPLANATION OF REFERENCE NUMERALS

1 injection valve body
10*c* orifice plate tip
15 orifice plate
15*a* seat surface
30 spherical portion
31*a* type determining hole
31*b*, 31*c* positioning hole
40, 43, 45 punch
40*a*, 43*a*, 45*a* punch cutting blade
41 die
42 collet chuck
54-59 orifice
544*a*-599*a* recess A
544-599 recess

The invention claimed is:

1. A machining method for forming an orifice in a curved surface portion or a slant surface portion in a fuel injection valve by operating a punch in an axial direction inclined relative to a normal direction perpendicular to a tangent plane of the curved surface portion or relative to a normal direction perpendicular to the slant surface of the slant surface portion and forming the orifice by press-working, the machining method comprising:

a first step of operating the punch along an axis pre-shifted in parallel in advance from an orifice axis and pressing an orifice plate to form a recess therein;

a second step, after the first step, of shifting the axis of the punch used in the first step to the position of the orifice axis and operating the punch at the position of the orifice axis to form a recess in a bottom of the recess formed in the first step, the recess formed in the second step being deeper than the recess formed in the first step; and a third step of forming an orifice in a bottom of the recess formed in the second step.

2. A machining method according to claim 1, wherein a fuel injecting portion comprising the orifice and the recess are formed in plural sets in the orifice plate, and a plurality of orifices are formed so as be mutually inclined.

3. A machining method according to claim 1, wherein the direction of parallel shift of the punch axis in the first step corresponds to a direction toward a deepest side of the recess formed in the first step.

4. A machining method according to claim 1, wherein the curved surface portion is spherical in shape.

5. A machining method according to claim 1, wherein in the second step the recess is formed in such a manner that the bottom thereof is a surface intersecting the orifice axis approximately perpendicularly.

6. A machining method according to claim 1, wherein the recess formed in the second step has an aspect ratio (hole depth/hole diameter) of 1 or more.

7. A machining method according to claim 1, wherein, after chucking a blank, at least the first, second and third steps are carried out without releasing the chucked state.

8. A machining method according to claim 1, wherein the orifice plate is formed of martensitic stainless steel having a carbon content of 0.25% or more and having a hardness after quenching of HRC 52 or more.

9. A press-working method for forming a hole in an axial direction in a curved surface portion or a slant surface portion by operating a punch in the axial direction, the axial direction being inclined relative to a normal direction perpendicular to a tangent plane of the curved surface portion or relative to a normal direction perpendicular to a slant surface of the slant surface portion, the press-working method comprising:

a first step of operating the punch along an axis pre-shifted in parallel in advance from a hole axis and pressing the curved surface portion or the slant surface portion to form a recess; and a second step, after the first step, of shifting the axis of the punch used in the first step to the position of the hole axis and forming operating the punch at the position of the orifice axis to form a hole in a bottom of the recess formed in the first step.

10. A press-working method according to claim 9, wherein a machining depth in the first step is set smaller than that in the second step.

* * * * *